US008220368B2

(12) United States Patent
Chen

(10) Patent No.: US 8,220,368 B2
(45) Date of Patent: Jul. 17, 2012

(54) SCREWDRIVER WITH CHANGEABLE HEAD

(75) Inventor: Yun-Jing Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 389 days.

(21) Appl. No.: 12/508,594

(22) Filed: Jul. 24, 2009

(65) Prior Publication Data

US 2011/0000346 A1 Jan. 6, 2011

(30) Foreign Application Priority Data

Jul. 1, 2009 (CN) ..... 2009 1 0303916

(51) Int. Cl.
*B25B 23/00* (2006.01)

(52) U.S. Cl. ..... 81/438; 81/436; 81/437; 81/439

(58) Field of Classification Search ..... 81/436, 81/437, 438, 439
See application file for complete search history.

(56) References Cited

U.S. PATENT DOCUMENTS 4,399,723 A * 8/1983 Marleau ..... 81/437
5,842,394 A * 12/1998 Hwang ..... 81/439
7,156,002 B1 * 1/2007 Chan ..... 81/177.4

* cited by examiner

*Primary Examiner* — Lee D Wilson
*Assistant Examiner* — Shantese McDonald
(74) *Attorney, Agent, or Firm* — Altis Law Group, Inc.

(57) ABSTRACT

A screwdriver is convenient for changing various heads. The heads can be easily detached from the screwdriver, and mounted to the screwdriver.

8 Claims, 7 Drawing Sheets

SCREWDRIVER WITH CHANGEABLE HEAD

BACKGROUND

1. Technical Field

The present disclosure relates to screwdrivers, and particularly to a screwdriver changeable head.

2. Description of Related Art

Generally, screwdrivers are integrally formed with a specific head, such as slotted or Phillips head. Because there are many types and sizes of screws, a user usually needs to buy many different screwdrivers for all their needs, which is inconvenient. Therefore, a screwdriver with replaceable heads was invented. However, many conventional replaceable heads are easily disengaged from the screwdriver, thereby making operation of the screwdriver inconvenient and time-consuming.

DETAILED DESCRIPTION

Figure 1:
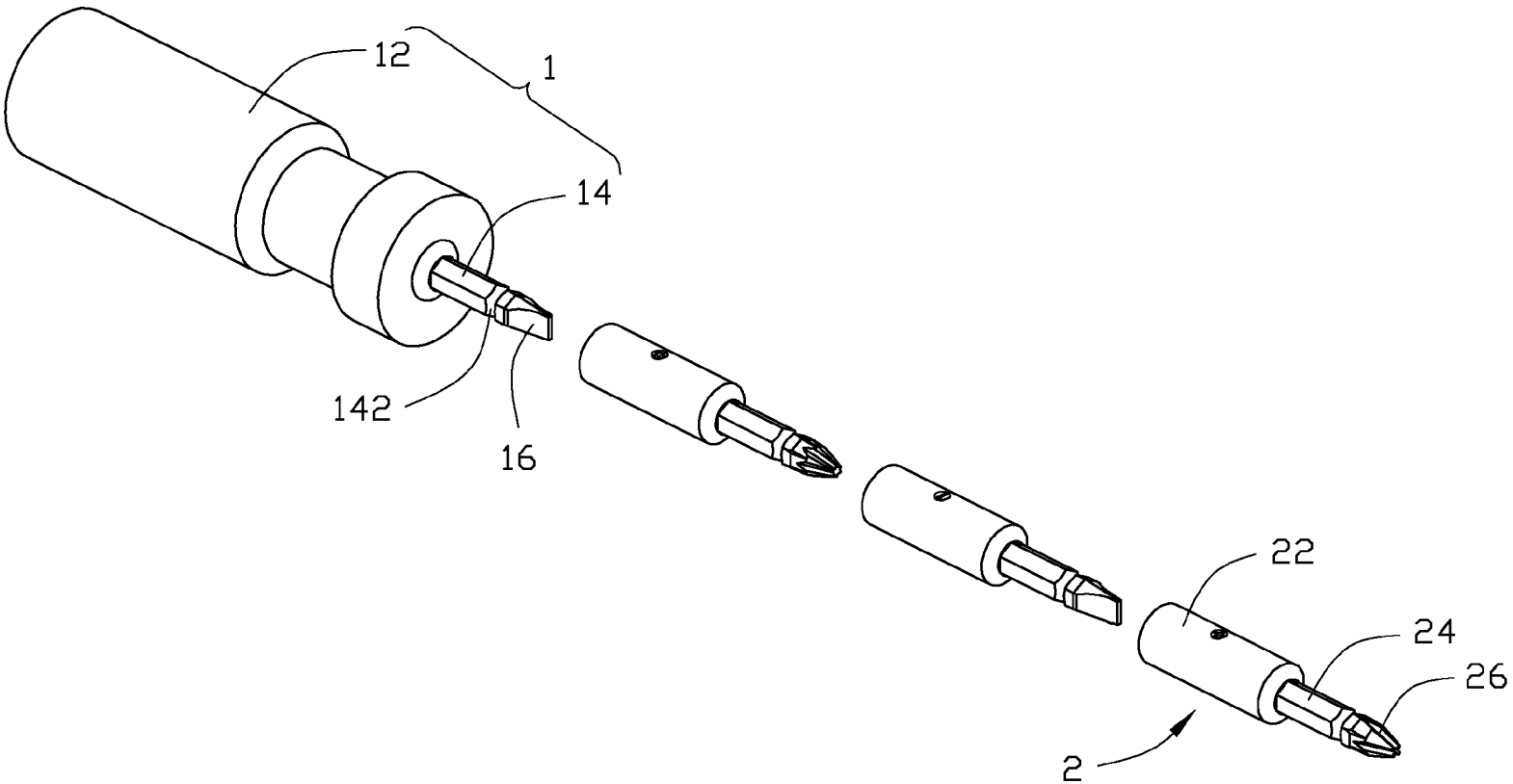
FIG. 1 is an exploded, isometric view of an exemplary embodiment of a screwdriver.
Figure 2:
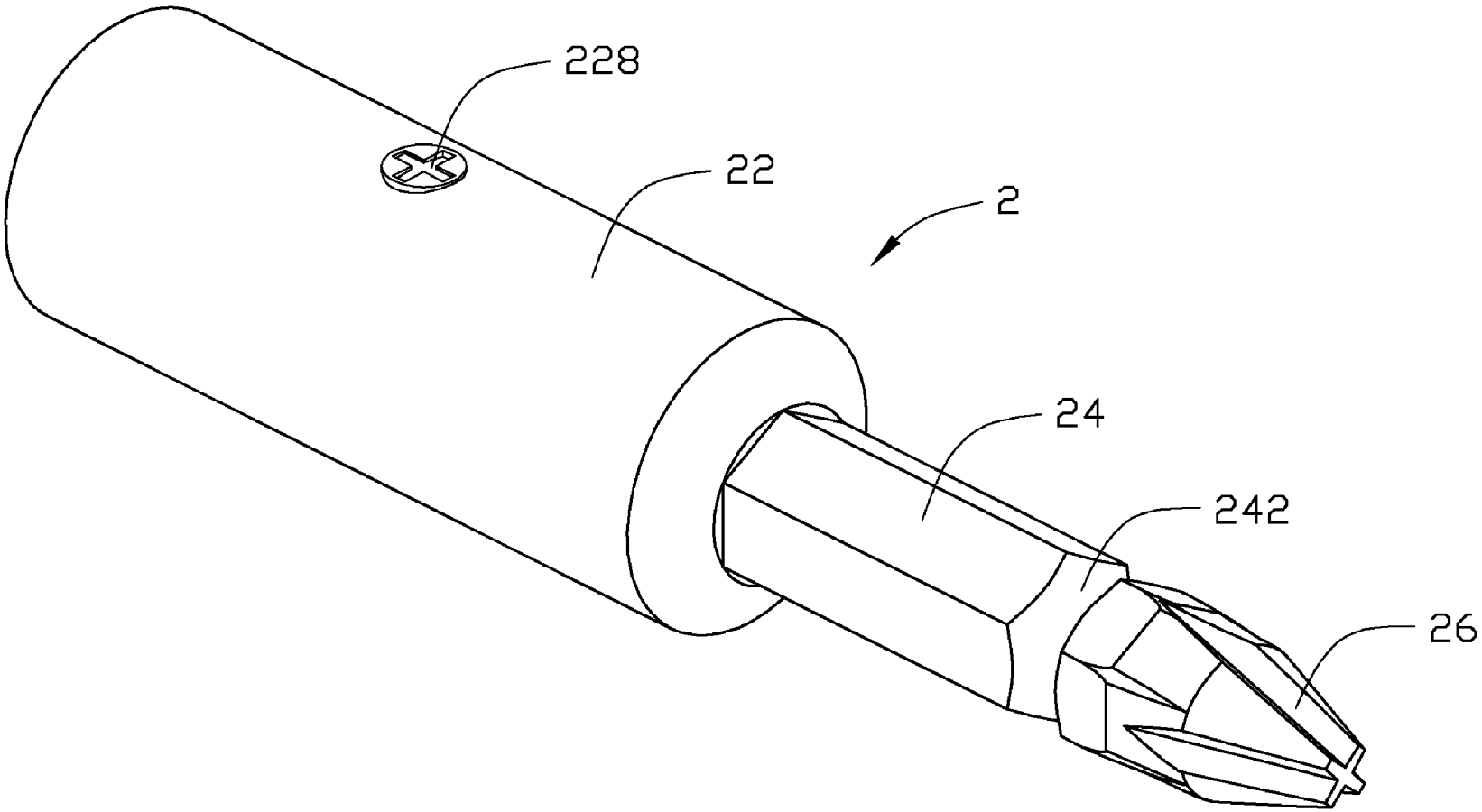
FIG. 2 is an enlarged, isometric view of a head of the screwdriver of FIG. 1.
Figure 3:
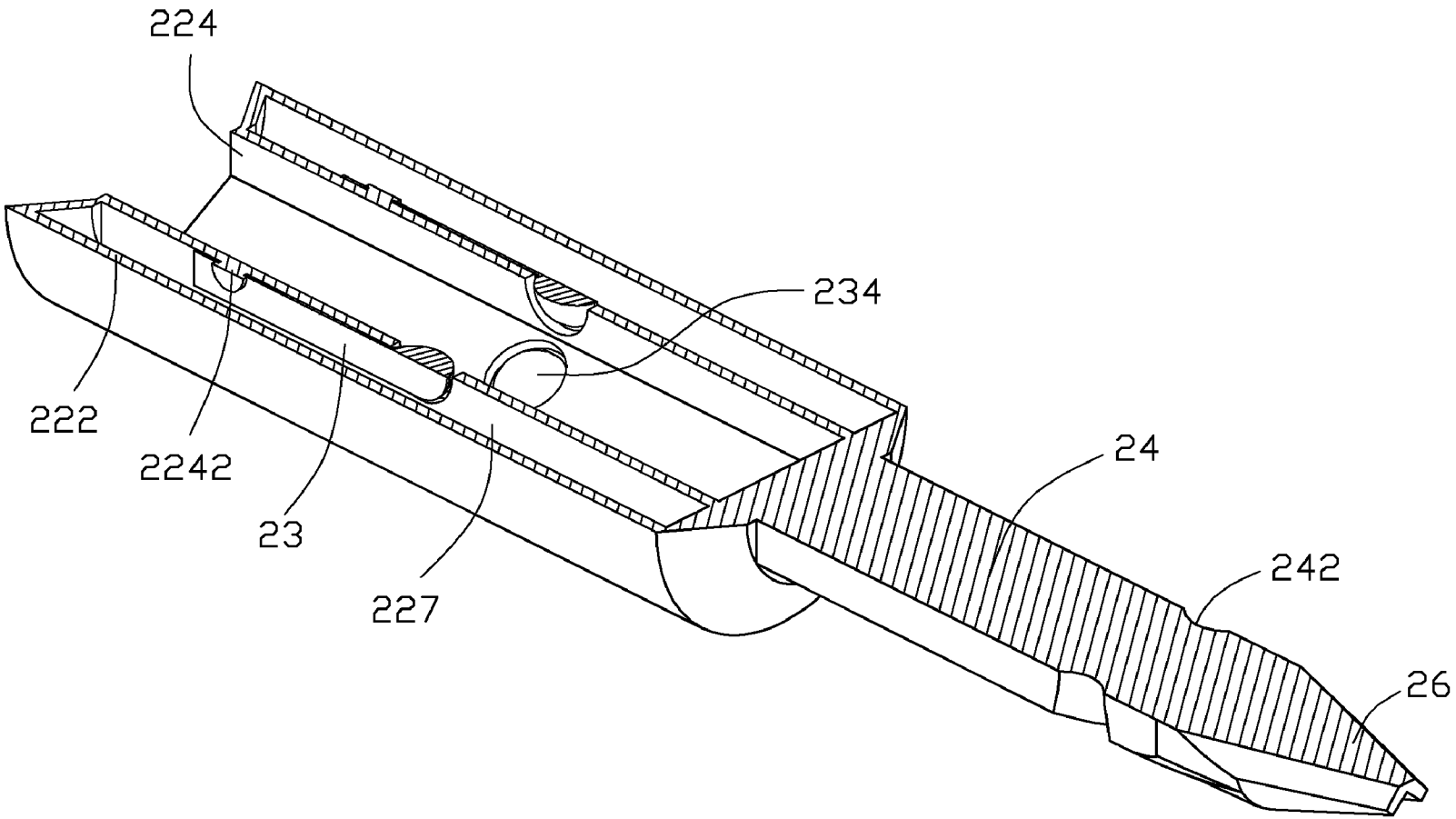
FIG. 3 is a cutaway, isometric view of FIG. 2.
Figure 4:
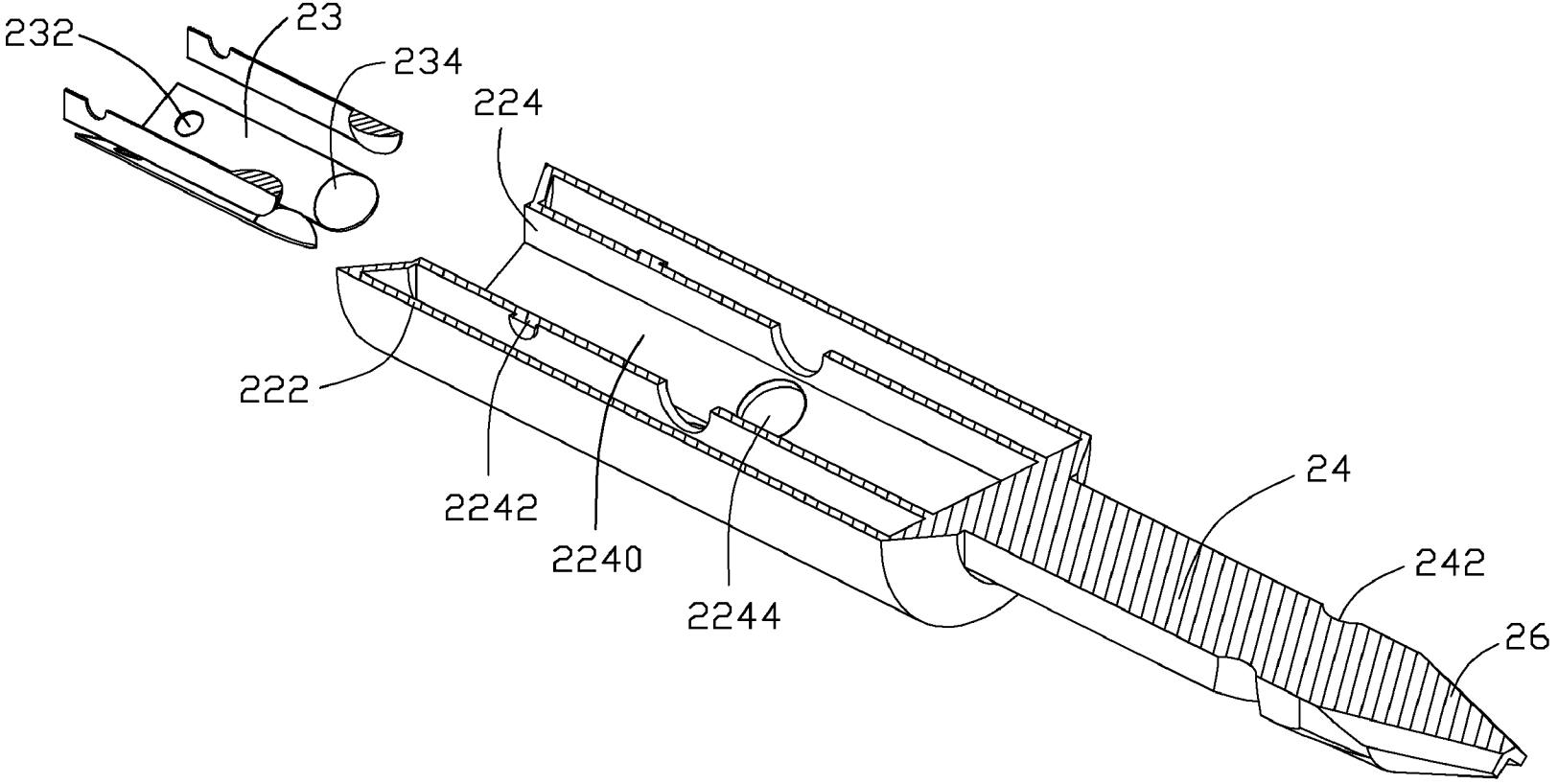
FIG. 4 is an exploded, isometric view of FIG. 3.
Figure 5:
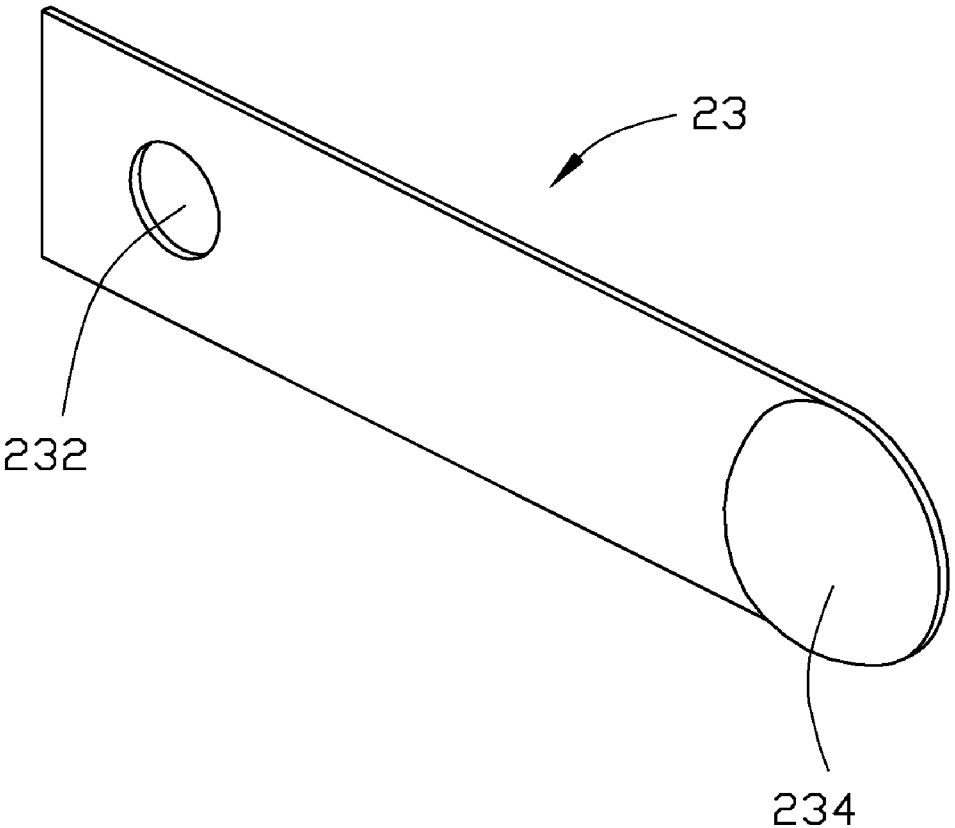
FIG. 5 is an enlarged, isometric view of an elastic member of FIG. 4.

Referring to FIG. 1, an exemplary embodiment of a screwdriver includes a handle 1 and a plurality of types of heads 2 capable of being sequentially attached to the handle 1.

Referring to FIGS. 2 to 6, each head 2 includes a cylindrical holder 22, a prismatic shank 24, and a blade 26 sequentially and integrally formed. An annular slot 242 is defined in an outside circumferential surface of the shank 24 adjacent to the blade 26.

The holder 22 includes an external first sleeve 222 with a cylindrical configuration, an internal second sleeve 224 with a prismatic configuration, and a plurality of elastic tabs 23 attached to the second sleeve 224. A space 227 is defined between the first sleeve 222 and the second sleeve 224, to receive the elastic tabs 23. The first sleeve 222 and the second sleeve 224 are co-axial. The second sleeve 224 includes a plurality of walls 2240 connected to each other at corresponding adjacent edges. Each of the walls 2240 includes a projection 2242 extending from an inside surface thereof and toward the first sleeve 222, and a round through hole 2244 located beside the projection 2242. The projection 2242 has a T-shaped cross-section. Each of the elastic tabs 23 includes a through hole 232 defined in one end thereof, and a semi-spherical shaped protrusion 234 extending from the other end thereof. The through hole 232 is capable of fixing around the projection 2242 of the second sleeve 242 and the protrusion 234 is capable of engaging in the through hole 2244 of the second sleeve 242 and extending out from the wall 2240, to attach the elastic tab 23 to the inside surface of the second sleeve 242. A label 228 indicating the type of the head 2 is formed on an outside surface of the first sleeve 222. In this embodiment, the label 228 is "+", indicating a crosshead type. In other embodiments, the label 228 may include numbers, for example, "+10" indicating that the head 2 is a No. 10 crosshead type.

Figure 7:
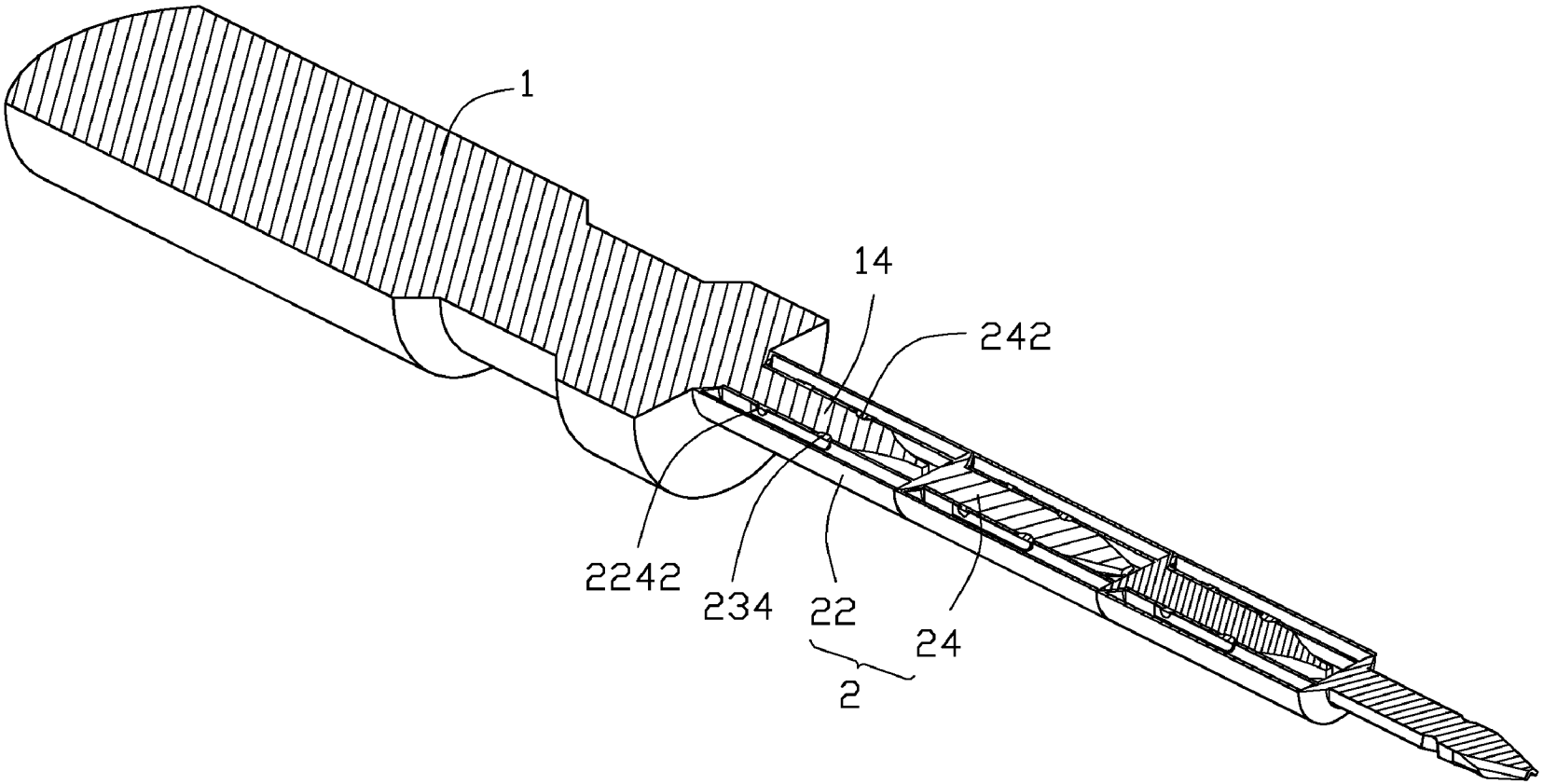
FIG. 7 is a cutaway, isometric view of FIG. 6.

Referring to FIG. 7, the handle 1 includes a cylindrical grabbing portion 12, and a prismatic shaft 14 integrally extending from one end of the grabbing portion 12, and a blade 16 integrally extending from a free end of the shaft 14. The shaft 14 and the blade 16 are similar to the shank 24 and the blade 26 of the head 2. An annular slot 142 is defined in an outside circumferential surface of the shaft 14 adjacent to the blade 16. In other embodiments, the shaft 14 can be mounted to the grabbing portion 12.

Figure 6:
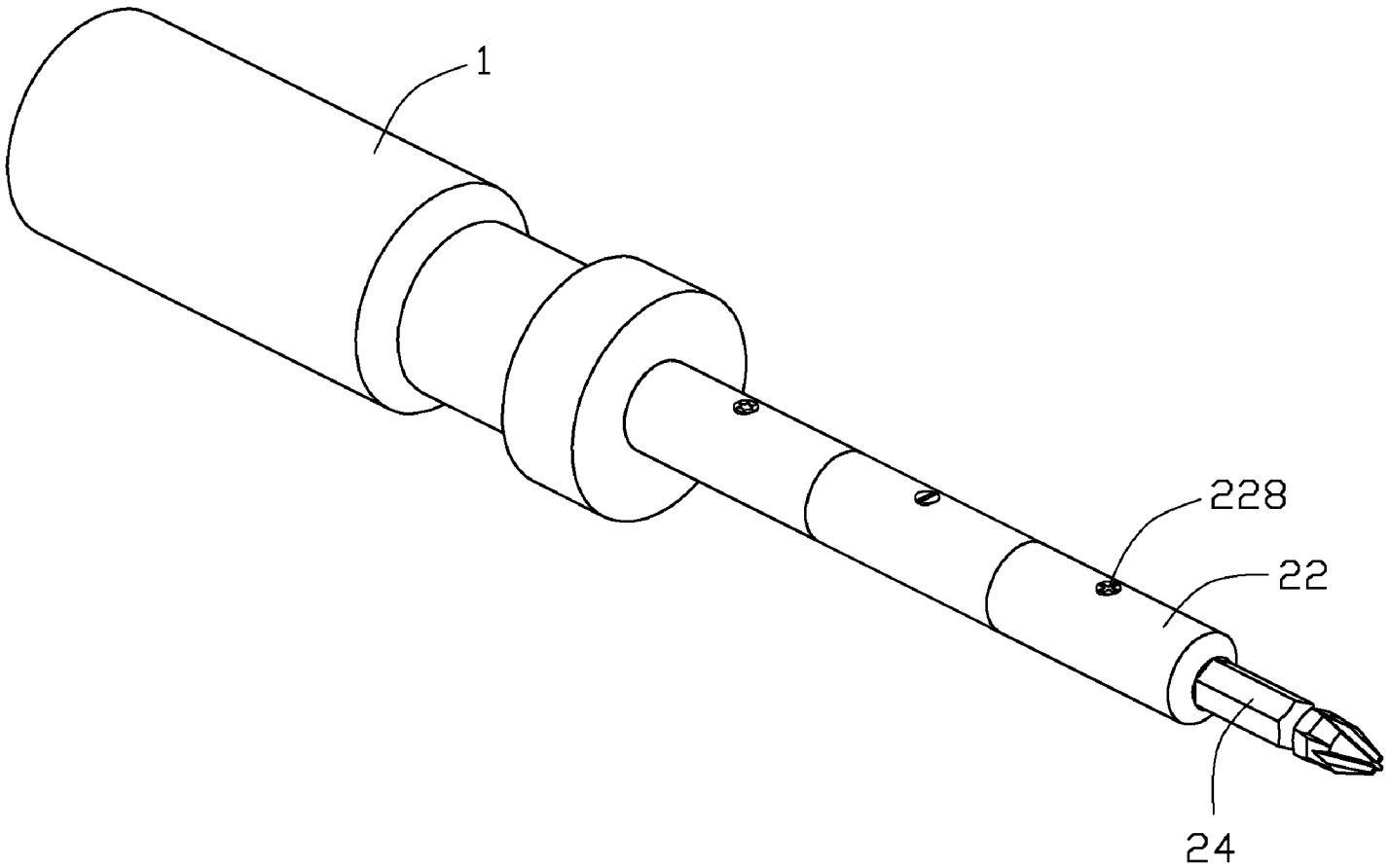
FIG. 6 is an assembled, isometric view of FIG. 1.

Referring to FIGS. 6 and 7, in assembly of the heads 2, the shank 24 of a first head 2 is slidably inserted into the holder 22 of a second head 2. The elastic tabs 23 of the second head 2 are deformed and then rebound, and the protrusions 234 of the second head 2 engage in the annular slot 242 of the shank 24 of the first head 2. In assembly of the heads 2 and the handle 1, the shaft 14 of the handle 1 is inserted into the holder 22 of the corresponding head 2, with protrusions 234 of the corresponding head 2 engaging in the annular slot 142 of the handle 1.

In use, various types of heads 2 can be quickly selected by observing the labels 228 on the heads 2. A selected head 2 can be mounted directly to the shaft 14 of the screwdriver or over another head 2 that is already mounted on the shaft 14 securely without easily disengaging unless a purposeful pulling force is applied by a user.

In other embodiments, the screwdriver can be an electric screwdriver. The label 228 can be formed on other positions of the holder 22 to facilitate identification of the types of the head 2.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A screwdriver comprising:

a handle; and a plurality of types of heads sequentially attached to the handle and each comprising:

a holder set on one end of the head, and comprising a first sleeve, and a second sleeve located in the first sleeve;

a blade set on the other end of the head;

a plurality of elastic tabs attached to the second sleeve; and a shank connected between the holder and the blade, defining a slot in an outside surface of the shank adjacent to the blade to engage with the elastic tabs of another head to mount the heads together;

wherein a space is defined between the first sleeve and the second sleeve, and the plurality of the elastic tabs are received in the space.

2. The screwdriver of claim 1, wherein a label indicating the type of the head is formed on an outside surface of the first sleeve of each holder.

3. The screwdriver of claim 1, wherein the second sleeve is a prismatic configuration and comprises a plurality of walls.

4. The screwdriver of claim 3, wherein a projection extends from an inside surface of each of the walls and toward the first sleeve, a through hole is defined in one end of each elastic tab, the through hole is to be fixed around the projection of the second sleeve, to attach the elastic tab to the second sleeve.

5. The screwdriver of claim 4, wherein a through hole is defined in the each of the walls and beside the projection, a protrusion extends from the other end of each elastic tab, and the protrusion is to engage in the through hole of the second sleeve and extend out from the wall.

6. The screwdriver of claim 1, wherein the handle comprises a grabbing portion, a shaft integrally extending from one end of the grabbing portion, and a blade.

7. The screwdriver of claim 6, wherein an annular slot is defined in an outside circumferential surface of the shaft; in each head, a through hole is defined in the second sleeve, a protrusion extends from the elastic tab, the protrusion is to engage in the through hole of the second sleeve and extend out from the wall to engage in the annular slot of the shaft.

8. A screwdriver comprising:

a handle; and a plurality of types of heads sequentially attached to the handle and each comprising:

a holder set on one end of the head, and comprising a first sleeve, and a second sleeve located in the first sleeve;

a blade set on the other end of the head;

a plurality of elastic tabs attached to the second sleeve; and a shank connected between the holder and the blade, defining a slot in an outside surface of the shank adjacent to the blade to engage with the elastic tabs of another head to mount the heads together;

wherein the handle comprises a grabbing portion, a shaft integrally extending from one end of the grabbing portion, and a blade; an annular slot is defined in an outside circumferential surface of the shaft; in each head, a plurality of through holes are defined in the second sleeve, a protrusion extends from each of the elastic tabs, the protrusions engage in the through holes of the second sleeve and extend out from the second sleeve; the protrusion of a selected one of the heads is to engage in the annular slot of the shaft or the slot of another head.

* * * * *